US010411410B2

(12) United States Patent
Chang

(10) Patent No.: US 10,411,410 B2
(45) Date of Patent: Sep. 10, 2019

(54) ELECTRICAL CONNECTOR ASSEMBLY

(71) Applicant: LOTES CO., LTD, Keelung (TW)

(72) Inventor: Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/868,011

(22) Filed: Jan. 11, 2018

(65) Prior Publication Data

US 2018/0212366 A1 Jul. 26, 2018

(30) Foreign Application Priority Data

Jan. 24, 2017 (CN) ..... 2017 2 0093901 U

(51) Int. Cl.
*H01R 13/6471* (2011.01)
*H01R 13/6585* (2011.01)
(Continued)

(52) U.S. Cl.
CPC ..... *H01R 13/6471* (2013.01); *H01R 13/405* (2013.01); *H01R 13/6585* (2013.01);
(Continued)

(58) Field of Classification Search
CPC .... H01R 13/6581; H01R 24/60; H01R 4/023; H01R 13/6585; H01R 13/6586; H01R 13/6471; H01R 13/6594; H01R 24/28; H01R 24/64; H01R 11/284; H01R 13/6461; H01R 13/6463; H01R 13/6469; H01R 13/6597; H01R 13/66; H01R 2201/04; H01R 25/00; H01R 12/716; H01R 13/405; H01R 13/6273; H01R 13/631; H01R 12/58; H01R 13/428; H01R 13/504; H01R 13/506; H01R 13/652; H01R 13/6582; H01R 13/6593; H01R 13/6658; H01R 24/22; H01R 24/62; H01R 4/027; H01R 12/52; H01R 12/598; H01R 12/707; H01R 12/724; H01R 12/775; H01R 13/04; H01R 13/112; H01R 13/20; H01R 13/424;
(Continued)

(56) References Cited

U.S. PATENT DOCUMENTS 6,390,852 B1 * 5/2002 Wang ..... H01R 13/6593 439/607.48
7,845,965 B2 * 12/2010 Ko ..... H01R 4/023 439/352
(Continued)

FOREIGN PATENT DOCUMENTS

CN 204011984 U 12/2014
CN 205565175 U 9/2016
CN 105990761 A 10/2016

*Primary Examiner* — James Harvey
*Assistant Examiner* — Matthew T Dzierzynski
(74) *Attorney, Agent, or Firm* — Tim Tingkang Xia, Esq.; Locke Lord LLP

(57) ABSTRACT

An electrical connector assembly includes an insulating body, multiple signal terminals received in the insulating body, a metal ground member fixed on the insulating body, and at least one ground core wires. The metal ground member has a plate surface and a cutting surface connected with the plate surface. The ground core wire is soldered to the cutting surface. The cutting surface is rough, the frictional force between the cutting surface and the ground core wires is great.

16 Claims, 11 Drawing Sheets

(51) Int. Cl.

| | |
|---|---|
| ***H01R 13/6597*** | (2011.01) |
| ***H01R 13/405*** | (2006.01) |
| ***H01R 13/6593*** | (2011.01) |
| ***H01R 13/506*** | (2006.01) |
| ***H01R 13/424*** | (2006.01) |
| ***H01R 13/6592*** | (2011.01) |

(52) U.S. Cl.
CPC ..... *H01R 13/6593* (2013.01); *H01R 13/6597* (2013.01); *H01R 13/424* (2013.01); *H01R 13/506* (2013.01); *H01R 13/6592* (2013.01)

(58) Field of Classification Search
CPC .. H01R 13/502; H01R 13/514; H01R 13/516; H01R 13/5845; H01R 13/6275; H01R 13/64; H01R 13/646; H01R 13/6474; H01R 13/6485; H01R 13/6583; H01R 13/6591; H01R 13/6592; H01R 13/6596; H01R 13/6683; H01R 24/76; H01R 31/08; H01R 43/0256; H01R 9/03
See application file for complete search history.

(56) References Cited

U.S. PATENT DOCUMENTS

| | | | | |
|---|---|---|---|---|
| 8,062,050 | B2 * | 11/2011 | Wu | H01R 13/6582 439/350 |
| 8,794,995 | B2 * | 8/2014 | Wu | H01R 12/598 439/497 |
| 8,894,447 | B2 * | 11/2014 | Canning | H01R 24/28 439/676 |
| 9,413,123 | B2 * | 8/2016 | Kao | H01R 24/64 |
| 9,660,399 | B2 * | 5/2017 | Hsu | H01R 24/60 |
| 2003/0073331 | A1 * | 4/2003 | Peloza | H01R 13/6473 439/108 |
| 2016/0322753 | A1 * | 11/2016 | Cheng | H01R 13/631 |
| 2017/0093091 | A1 * | 3/2017 | Cheng | H01R 4/023 |

* cited by examiner

ELECTRICAL CONNECTOR ASSEMBLY

CROSS-REFERENCE TO RELATED APPLICATION

This non-provisional application claims priority to and benefit of, under 35 U.S.C. § 119(a), Patent Application No. 201720093901.9 filed in P.R. China on Jan. 24, 2017, the entire content of which is hereby incorporated by reference.

FIELD OF THE INVENTION

The present invention relates to an electrical connector assembly, and more particularly to an electrical connector assembly in which terminals are directly soldered to a cable.

BACKGROUND OF THE INVENTION

An existing electrical connector assembly includes an insulating body, multiple signal terminals arranged in the insulating body, a metal ground member fixed in the insulating body, and a cable having multiple signal core wires and multiple ground core wires. The signal core wires are soldered correspondingly to the plate surfaces of the signal terminals, and the ground core wires are soldered correspondingly to the plate surfaces of the ground member. However, because the plate surface of the metal ground member is a horizontal smooth plane and each ground core wire is cylindrical, when the ground core wires are soldered horizontally to the plate surfaces of ground terminals, the ground core wires can easily roll relative to the plate surfaces of the ground terminals. As a result, the ground core wires cannot be easily soldered firmly, and missing solder can be caused easily. Further, when the cable is pulled by external force, the soldered portions of the metal ground member and the ground core wires can easily get loose, causing poor contact, and then the poor shielding effect of the metal ground member is caused.

Therefore, a heretofore unaddressed need exists in the art to address the aforementioned deficiencies and inadequacies.

SUMMARY OF THE INVENTION

In one aspect, the present invention relates to an electrical connector assembly that solders a ground core wire to a cutting surface of a metal ground member, so that the metal ground member can be soldered firmly to the ground core wire, ensuring that the metal ground member has a good shielding effect.

In certain embodiments, an electrical connector assembly includes an insulating body, multiple signal terminals received in the insulating body, a metal ground member fixed in the insulating body, and a cable. The metal ground member has a plate surface and a cutting surface connected with the plate surface. The cable has signal core wires and at least one ground core wire. The signal core wires are soldered correspondingly to the signal terminals, and the ground core wire is soldered to the cutting surface.

In certain embodiments, the metal ground member is a ground terminal, the ground terminal is located at the outermost side of the signal terminals, the front end of the ground terminal is provided with a contact portion, the rear end is provided with a soldering portion which protrudes out of the insulating body, at least one of an upper surface and a lower surface of the soldering portion is provided with the plate surface, and the inner side of the soldering portion is provided with the cutting surface perpendicular to the plate surface.

In certain embodiments, in the ground terminal, a deflecting portion is formed by deflecting and extending from the contact portion in a direction away from one side of the signal terminals, a connecting portion is formed by extending backward from the deflecting portion, a bending portion is formed by being bent and extending from the connecting portion, and a soldering portion is formed by horizontally extending backward from the bending portion.

In certain embodiments, the front end of the insulating body is provided with a backwardly recessed insertion cavity, the plurality of signal terminals are arranged respectively on the upper side and lower side of the insertion cavity to form an upper row and a lower row, the ground terminals are arranged respectively on the outermost side of the plurality of signal terminals of each row, and there are two ground core wires, which are respectively soldered correspondingly to the cutting surface of the upper row and the cutting surface of the lower row.

In certain embodiments, among the two ground terminals on the same side of the insertion cavity along the vertical direction, the width of the soldering portion of the ground terminal in the upper row is less than the width of the soldering portion of the ground terminal in the lower row, so that the cutting surface of the ground terminal in the upper row can be soldered to the side surface of the ground core wire and the plate surface of the ground terminal in the lower row can be soldered to the lower surface of the ground core wire.

In certain embodiments, the ground terminal in the upper row and the ground terminal in the lower row are arranged in mutual point symmetry with the central point of the insertion cavity as a center of symmetry.

In certain embodiments, a shielding sheet is fixed in the insulating body and located between the upper row of signal terminals and the lower row of signal terminals, and the ground core wires are located between the ground terminals and the shielding sheet and soldered to the shielding sheet.

In certain embodiments, at least one power terminal is also arranged among the plurality of signals of each row, and the plurality of signal terminals, the ground terminal and the power terminal of the upper row and the plurality of signal terminals, the ground terminal and the power terminal of the lower row are arranged in mutual point symmetry with the central point of the insertion cavity as a center of symmetry In certain embodiments, the shielding sheet is provided with a base fixed in the insulating body, an extension portion extends backward from the base, at least one yield slot is recessed forwardly from the rear end edge of the extension portion, the power terminal in the upper row partially extends in to get over the yield slot, the power terminal in the lower row partially extends in to get under the yield slot, the cable is provided with at least one power core wire, and the power core wire is located in the yield slot and soldered to the power terminal of the upper row and the power terminal of the lower row.

In certain embodiments, the upper surface and lower surface of the rear end of the insulating body are provided respectively with at least one slot corresponding to the yield slot, and both the power terminal in the upper row and the power terminal in the lower row are provided with two soldering pins which are respectively located correspondingly in the slots so as to be soldered to the power core wire.

In certain embodiments, the width of the yield slot is greater than the width of the soldering pin.

In certain embodiments, the ground terminal, the power terminal and the plurality of signal terminals in the upper row and an upper insulating block are molded by injection as a whole, the ground terminal, the power terminal and the plurality of signal terminals in the lower row and a lower insulating block are molded by injection as a whole, the rear end of the insulating body is provided with a forward receiving cavity, the upper insulating block and the lower insulating block jointly clamp and fix the shielding sheet and are mounted in the receiving cavity, and form a placement platform which protrudes out of the rear end of the receiving cavity, the plurality of signal core wires are arranged respectively in two rows on the upper surface and lower surface of the placement platform so as to be soldered correspondingly to the plurality of signal terminals of the upper row and the plurality of signal terminals of the lower row, and the two ground core wires are located respectively on the two opposite outer sides of the placement platform so as to be soldered to the cutting surface of the upper row and the cutting surface of the lower row.

In certain embodiments, the metal ground member is a shielding sheet, the plurality of signal terminals are arranged into an upper row and a lower row in the insulating body, the shielding sheet is located between the signal terminals of the upper row and the signal terminals of the lower row, both the upper surface and lower surface of the shielding sheet are provided with the plate surfaces, and at least one side of the shielding sheet is provided with the cutting surface.

In certain embodiments, the shielding sheet is provided with a base fixed in the insulating body, a pair of latch arms respectively extends forward from both sides of the base and are received in the insulating body, an extension portion extends backward from the base, both opposite sides of the extension portion are provided with the cutting surfaces, and there are two ground core wires, which are respectively soldered correspondingly to the cutting surfaces of both sides of the extension portion.

In certain embodiments, two opposite sides of the rear end of the extension portion are provided respectively with a concave notch, so that a stepped surface is formed on the front side of each notch, each stepped surface is the cutting surface, and the ground core wires are received partially in the notches so as to be soldered to the stepped surfaces.

In certain embodiments, the metal ground member is a shielding shell, the shielding sheet wraps the periphery of the insulating body, the outer wall surface of the shielding sheet is the plate surface, and the rear end of the shielding sheet is provided with the cutting surface.

In certain embodiments, a recessed portion is recessed forwardly from at least one side of the rear end of the shielding sheet, a wall surface of the recessed portion is the cutting surface, and the ground core wire gets into the recessed portion so as to be soldered to the cutting surface.

In certain embodiments, the front end of the insulating body is provided with a backwardly recessed insertion cavity, the plurality of signal terminals are arranged respectively on the upper side and lower side of the insertion cavity to form an upper row and a lower row, at least one ground terminal is arranged on the outermost side of the plurality of signal terminals of each row, each ground terminal is provided with a soldering portion, the soldering portion of the upper row and the soldering portion of the lower row respectively clamp the upper side and lower side of the ground core wire and are soldered to the ground core wire, and the cutting surface is located between the soldering portion of the upper row and the soldering portion of the lower row along the vertical direction and soldered to the ground core wire.

In certain embodiments, an outer side of the soldering portion of each ground terminal urges against the shielding sheet.

In certain embodiments, a shielding sheet is fixed in the insulating body and located between the upper row of signal terminals and the lower row of signal terminals, there are two ground core wires, the shielding sheet is provided with two opposite sides which are soldered respectively to the side surfaces of the ground core wires, and the two opposite sides of the rear end of the shielding sheet are provided respectively with the cutting surfaces which are soldered to the ground core wires.

Compared with the related art, the present invention has the following advantages: the metal ground member is fixed in the insulating body, the metal ground member is provided with the plate surface and the cutting surface connected with the plate surface, and the ground core wires are soldered to the cutting surface; because the cutting surface is rough, the frictional force between the cutting surface and the ground core wires is great, consequently, the cutting surface can be soldered conveniently to the ground core wires, and is soldered firmly, missing soldering cannot be caused easily, the soldered portions of the metal ground member and the ground core wires cannot get loose even if the cable is pulled by external force, poor electrical contact is prevented, and it is ensured that the metal ground member has a good shielding effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
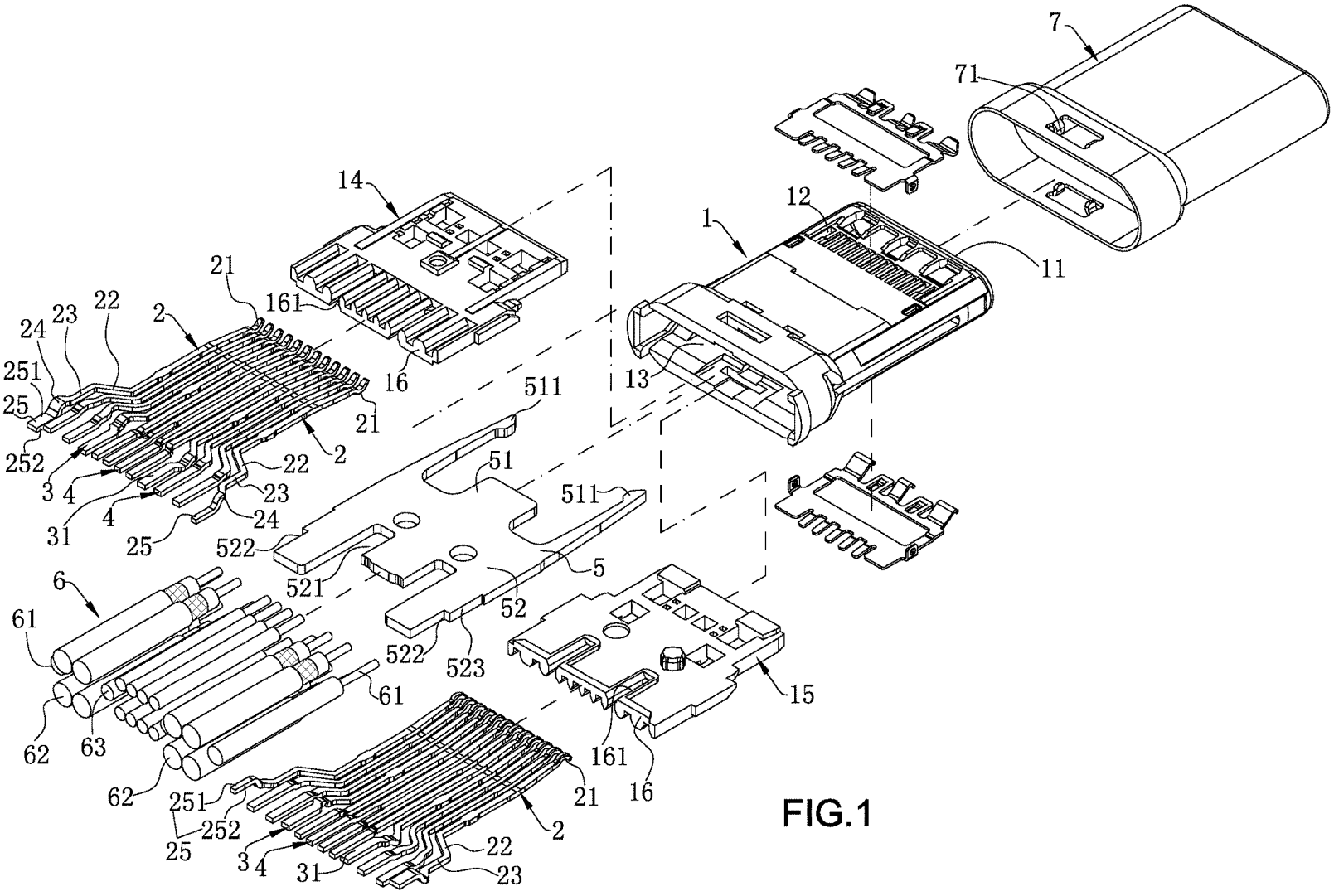
FIG. 1 is a schematic three-dimensional exploded view of an electrical connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector assembly.

Figure 2:
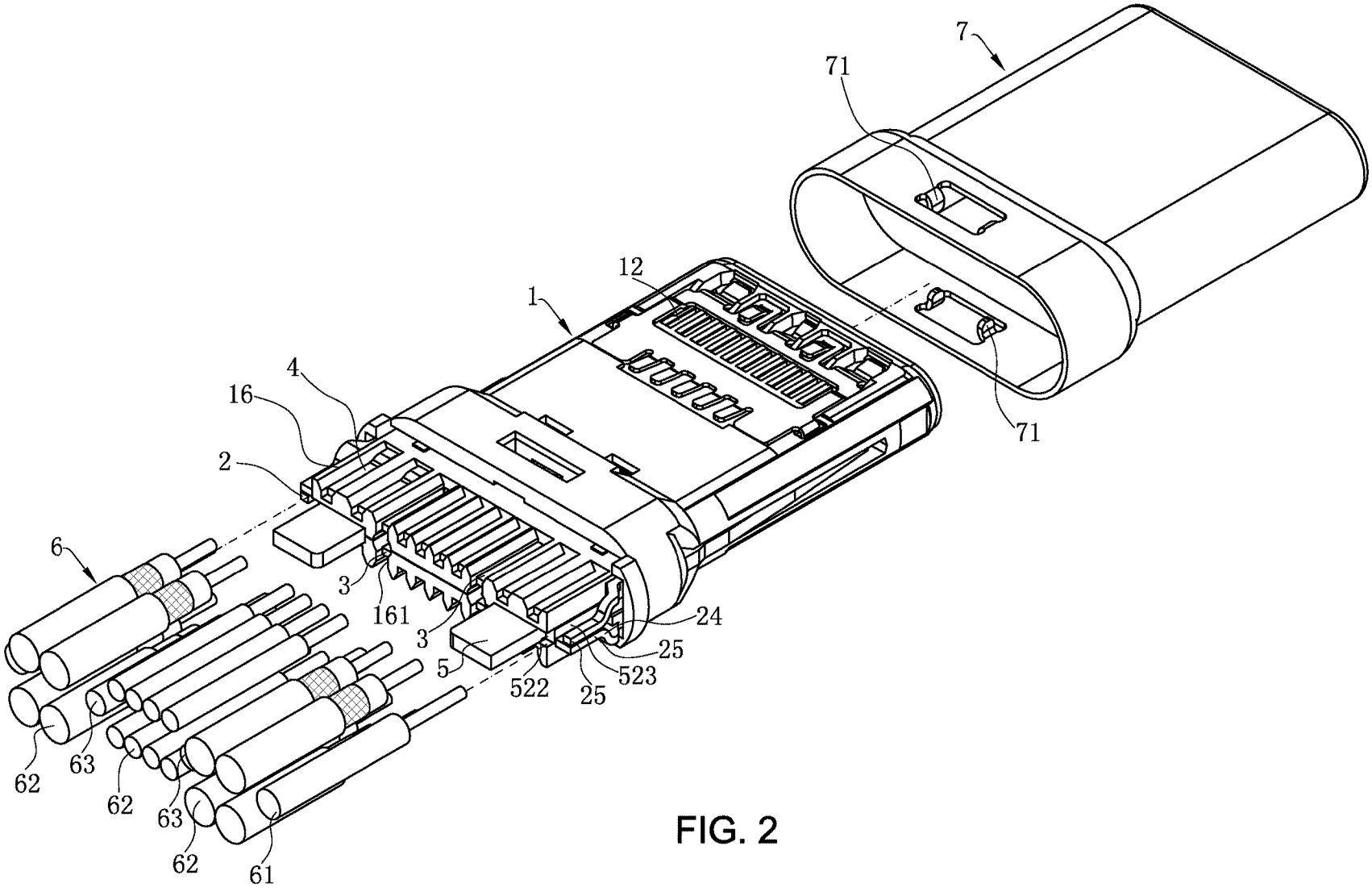
FIG. 2 is a partial assembly view of an electrical connector assembly according to one embodiment of the present invention.
Figure 3:
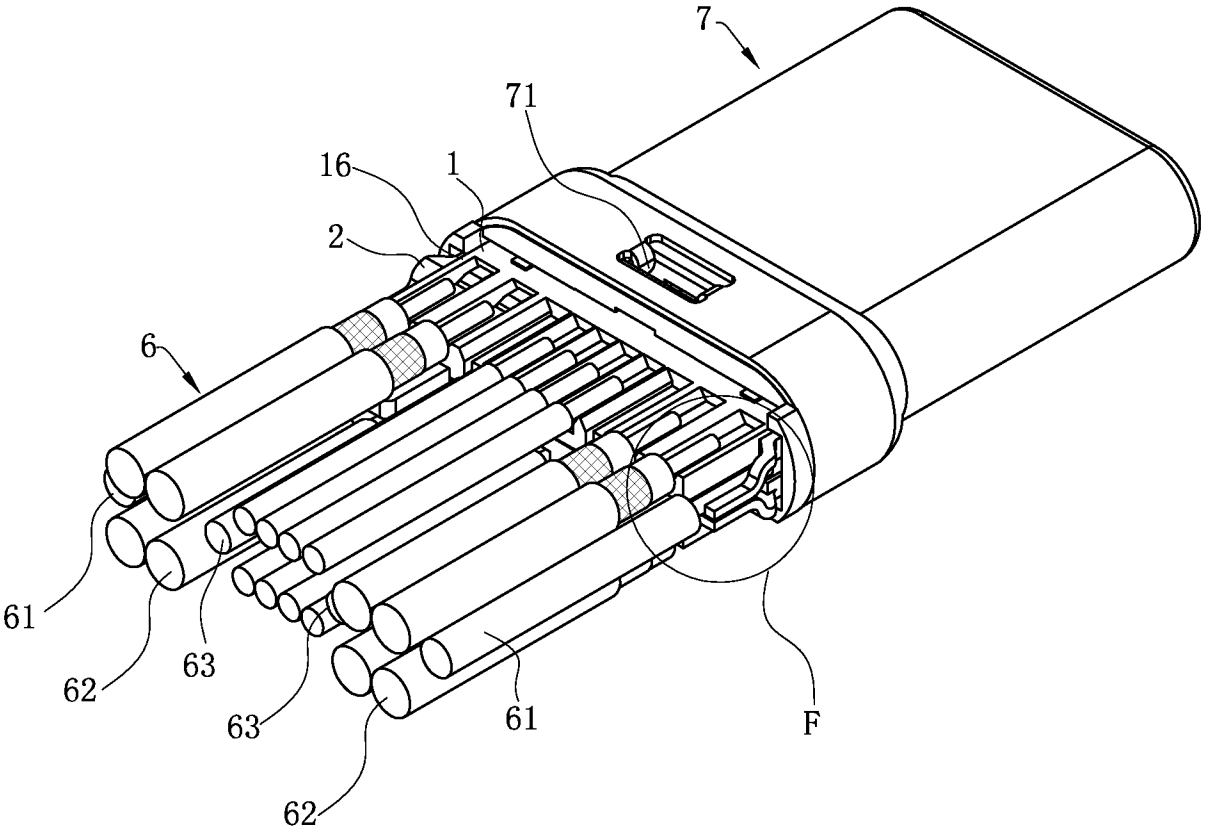
FIG. 3 is an assembly view of an electrical connector assembly according to one embodiment of the present invention.
Figure 4:
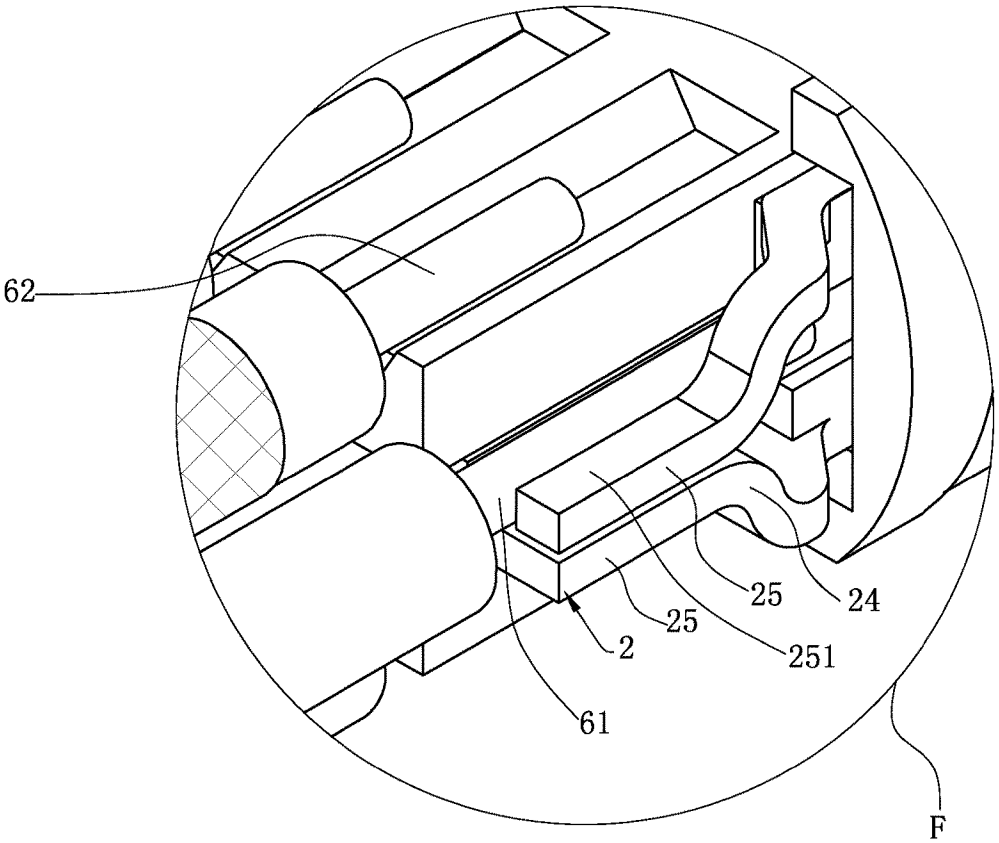
FIG. 4 is an enlarged view of part F in FIG. 3.

As shown in FIGS. 1 and 2, an electrical connector assembly of the present invention includes an insulating body 1, multiple signal terminals 4 received in the insulating body 1, a metal ground member fixed in the insulating body 1, a cable 6, and a shielding shell 7. The metal ground member in the present embodiment is a ground terminal 2. A shielding sheet 5 is fixed in the insulating body 1 and located on one side of the signal terminals 4. The cable 6 has multiple signal core wires 62 and at least one ground core wire 61. The signal core wires 62 are soldered correspondingly to the signal terminals 4. The ground core wire 61 is soldered to the ground terminal 2. The shielding shell 7 wraps and is fixed on the periphery of the insulating body 1.

As shown in FIGS. 1-4, the front end of the insulating body 1 is recessed backward to form an insertion cavity 11. The insertion cavity 11 is configured to receive a tongue (not shown) of the corresponding receptacle connector. Multiple terminal slots 12 are recessed respectively from the top surface and bottom surface of the insulating body 1. The terminal slots 12 communicate with the insertion cavity 11. The signal terminals 4 are received in the insertion cavity 11 and correspondingly extend into the terminal slots 12. The signal terminals 4 are arranged respectively on the upper side and lower side of the insertion cavity 11 to form an upper row and a lower row. The ground terminals 2 are arranged respectively on the outermost side of the signal terminals 4 of each row. The ground terminals 2 are received in the insertion cavity 11 and correspondingly extend into the terminal slots 12. At least one power terminal 3 is also arranged among the signal terminals 4 of each row. The power terminals 3 are received correspondingly in the terminal slots 12 and extend into the insertion cavity 11. The cable 6 is provided with at least one power core wire 63, and the power terminals 3 are soldered to the power core wire 63.

As shown in FIGS. 1-4, an upper insulating block 14 and a lower insulating block 15 are arranged in the insulating body 1. The ground terminal 2, the power terminal 3 and the signal terminals 4 in the upper row and the upper insulating block 14 are inject molded as a whole. The ground terminal 2, the power terminal 3 and the signal terminals 4 in the lower row and the lower insulating block 15 are inject molded as a whole. The rear end of the insulating body 1 is provided with a receiving cavity 13 recessed forward. The upper insulating block 14 and the lower insulating block 15 jointly clamp and fix the shielding sheet 5 and are mounted in the receiving cavity 13, and form a placement platform 16 which protrudes out of the rear end of the receiving cavity 13. The signal core wires 62 are arranged respectively in two rows on the upper surface and lower surface of the placement platform 16 so as to be soldered correspondingly to the signal terminals 4 of the upper row and the signal terminals 4 of the lower row. The ground core wire 61 is located on the outer side of the placement platform 16 and soldered to the ground terminal 2 of the upper row and the ground terminal 2 of the lower row. At least one open slot 161 runs through each of the upper surface and lower surface of the placement platform 16 along the vertical direction. In the present embodiment, the upper surface and lower surface of the placement platform 16 are provided respectively with two slots 161, and the two slots 161 are arranged separately, and respectively run through the upper insulating block 14 and the lower insulating block 15 along the vertical direction. In the other embodiments, the placement platform 16 can also be provided with only one open slot 161.

As shown in FIGS. 3-7, the ground terminal 2 is provided with a plate surface 251 and a cutting surface 252 connected with the plate surface 251. The plate surface 251 is a smooth surface, and the cutting surface 252 is a rough surface perpendicular to the plate surface 251. The cutting surface 252 is rougher than the plate surface 251. Since the cutting surface 252 are rough, the frictional force between the cutting surfaces 252 and the ground core wires 61 is great. Consequently, the cutting surfaces 252 can be soldered conveniently to the ground core wires 61, and are soldered firmly, missing soldering cannot be caused easily, the soldered portions of the ground terminals 2 and the ground core wires 61 cannot get loose even if the cable 6 is pulled by external force, poor electrical contact is prevented, and it is ensured that the ground terminals 2 have a good shielding effect. The front end of each ground terminal 2 is provided with a contact portion 21, the rear end is provided with a soldering portion 25 which protrudes out of the placement platform 16. At least one of an upper surface and a lower surface of the soldering portion 25 is provided with the plate surface 251. In the present embodiment both the upper surface and lower surface of the soldering portion 25 are provided with the plate surfaces 251. The inner side of the soldering portion 25 is provided with the cutting surface 252 perpendicular to the plate surfaces 251, and the inner side of the soldering portion 25 is a side which is close to the signal terminals 4. Two ground terminals 2 are arranged on the outermost side of the plurality of signal terminals 4 of each row, and correspondingly, there are two ground core wires 61. The two ground terminals 2 in the upper row and the two ground terminals 2 in the lower row are aligned with each other in the vertical direction. The widths of the soldering portions 25 of the two ground terminals 2 of each row are different. That is, in one side, among the two ground terminals 2 located on the same side of the insertion cavity 11 along the vertical direction and aligned with each other, the width of the soldering portion 25 of the ground terminal 2 in the upper row is less than the width of the soldering portion 25 of the ground terminal 2 in the lower row, so that the cutting surface 252 of the ground terminal 2 in the upper row can be soldered to the side surface of the ground core wire 61 and the plate surface 251 of the ground terminal 2 in the lower row can be soldered to the lower surface of the ground core wire 61. Among the two ground terminals 2 located on the other opposite side of the insertion cavity 11 along the vertical direction and aligned with each other, the width of the soldering portion 25 of the ground terminal 2 in the lower row is less than the width of the soldering portion 25 of the ground terminal 2 in the upper row, so that the cutting surface 252 of the ground terminal 2 in the lower row can be soldered to the side surface of the ground core wire 61 and the plate surface 251 of the ground terminal 2 in the upper row can be soldered to the lower surface of the ground core wire 61. That is, the two ground terminals 2 in the upper row and the two ground terminals 2 in the lower row are arranged in mutual point symmetry with the central point of the insertion cavity 11 as a center of symmetry.

Figure 5:
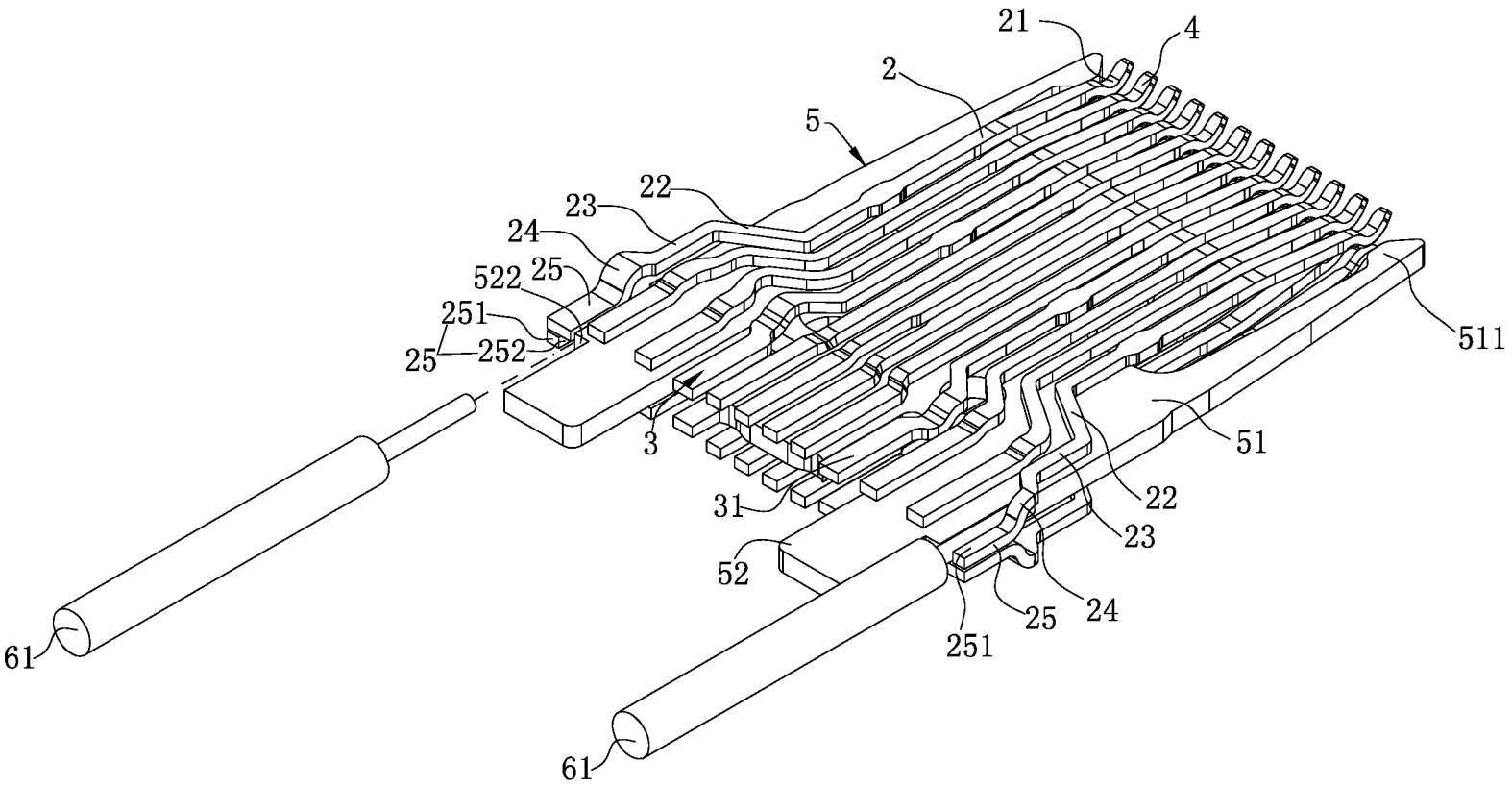
FIG. 5 is a schematic view of soldering of metal ground members and ground core wires according to one embodiment of the present invention.
Figure 6:
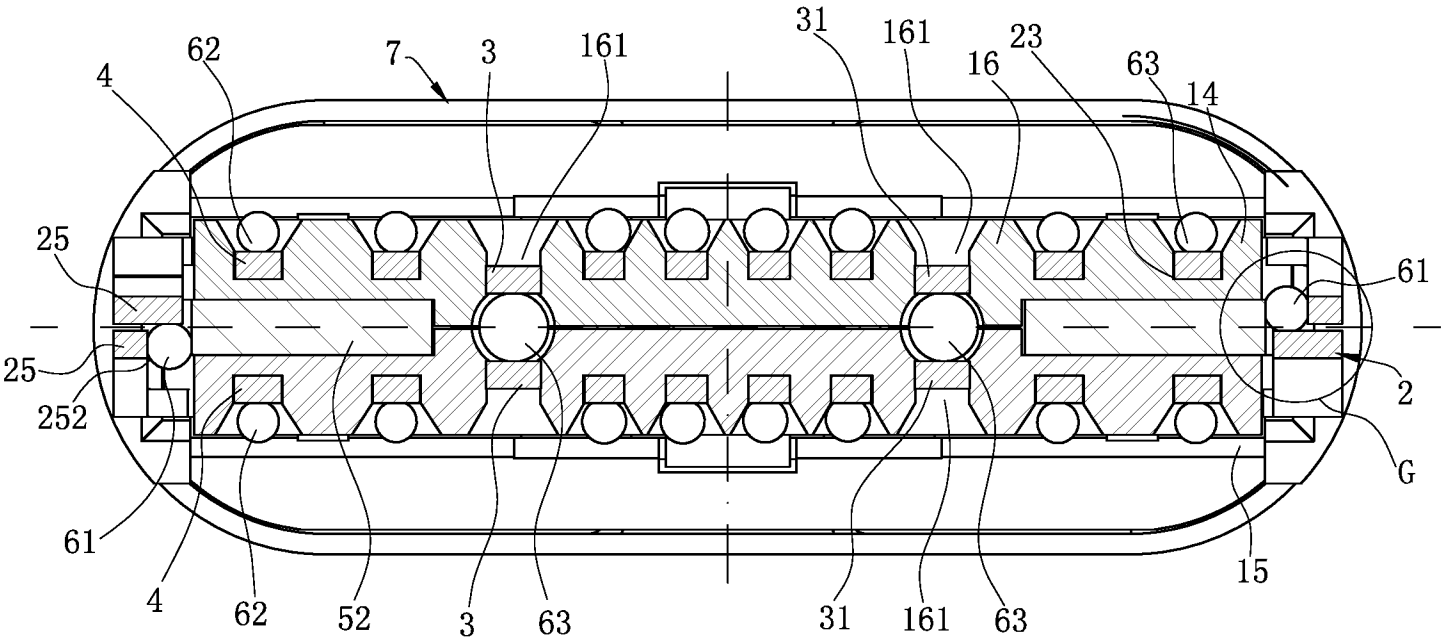
FIG. 6 is a sectional view of an electrical connector assembly according to one embodiment of the present invention.

As shown in FIGS. 1, 5 and 6, in each ground terminal 2, a deflecting portion 22 is formed by deflecting and extending from the contact portion 21 in a direction away from one side of the signal terminals 4, a connecting portion 23 is formed by extending backward from the deflecting portion 22, a bending portion 24 is formed by being bent and extending from the connecting portion 23, and the soldering portion 25 is formed by horizontally extending backward from the bending portion 24. The arrangement of the deflecting portions 22 increases the distance between the two soldering portions 25 of the same row, so that the space for receiving the signal core wires 62 is enlarged. Consequently, the signal core wires 62 can be soldered conveniently to the signal terminals 4. Moreover, since the soldering portions 25 are all located on the outer side of the placement platform 16 and soldered to the ground core wires 61, the space of the placement platform 16 is not occupied. Consequently, the space of the placement platform 16 is saved, and the overall volume of the electrical connector assembly is reduced.

As shown in FIGS. 1, 5 and 6, the signal terminals 4, the ground terminals 2 and the power terminal 3 of the upper row and the signal terminals 4, the ground terminals 2 and the power terminal 3 of the lower row are arranged in mutual point symmetry with the central point of the insertion cavity 11 as a center of symmetry. In the present embodiment, each row is provided with twelve terminals, the arrangement sequences are the same, and the arrangement sequence of the terminals of each row is: a ground terminal 2 (ground terminal GND), a high-speed signal terminal pair (SSTXpl and SSTXn1), a power terminal 3 (Vbus), a detection terminal (CC), a USB2.0 terminal pair (D+ and D−), a reserved terminal (Vconn), a power terminal 3 (Vbus), a high-speed signal terminal pair (SSTXn1 and SSTXpl) and a ground terminal 2 (ground terminal GND).

In the present embodiment, there are two ground terminals 2 and two power terminals 3 in each row. The ground terminals 2 in the upper row are aligned with the ground terminals 2 in the lower row in the vertical direction, and the power terminals 3 in the upper row are aligned with the power terminals 3 in the lower row in the vertical direction, and correspondingly. There are two ground core wires 61 and two power core wires 63. In the other embodiments, there can be one or more ground terminals 2, power terminals 3, ground core wires 61 and power core wires 63 in each row, as long as it is ensured that the numbers of the ground core wire 61 and the power core wire 63 correspond to the numbers of the ground terminal 2 and power terminal 3 of each row. Each of the power terminals 3 in the upper row and the power terminals 3 in the lower row is provided with a soldering pin 31. The two soldering pins 31 in the upper row are respectively located correspondingly in the two slots 161 of the upper surface of the placement platform 16 so as to be soldered to the two power core wires 63, and the two soldering pins 31 in the lower row are respectively located correspondingly in the two slots 161 of the lower surface of the placement platform 16 so as to be soldered to the two power core wires 63. The signal core wires 62 in two rows are arranged respectively on the upper surface and lower surface of the placement platform 16 so as to be soldered correspondingly to the signal terminals 4 of the upper row and the plurality of signal terminals 4 in the lower row, and the two ground core wires 61 are located respectively on the two opposite outer sides of the placement platform 16 and soldered to the cutting surfaces 252 of the upper row and the cutting surfaces 252 of the lower row.

As shown in FIGS. 1, 5 and 6, the shielding sheet 5 is in a shape of a flat plate, the shielding sheet 5 is fixed in the insulating body 1 and located between the upper row of signal terminals 4 and the lower row of signal terminals 4. The upper insulating block 14 and the lower insulating block 15 jointly clamp and fix the shielding sheet 5. The ground core wires 61 are located between the ground terminals 2 and the shielding sheet 5 and soldered to the shielding sheet 5. That is, the ground terminals 2 and the shielding sheet 5 jointly clamp and fix the ground core wires 61, preventing the ground core wires 61 from shifting to cause the soldered portions to get loose. The front end of the shielding sheet 5 is provided with a base 51 fixed in the insulating body 1. A pair of latch arms 511 respectively extends forward from both sides of the base 51 to enter the insertion cavity 11, and the latch arms 511 are configured to be fastened with the connector receptacle. An extension portion 52 extends backward from the base 51. The extension portion 52 is in a shape of a flat plate. At least one yield slot 521 is recessed forward from the rear end edge of the extension portion 52. In the present embodiment, two yield slots 521 are arranged to correspond to the two power terminals 3. In the other embodiments, there can be one or more yield slots 521, as long as the number of the yield slots 521 corresponds to the number of the power terminals 3. The power terminals 3 in the upper row partially extend in to get over the yield slots 521, that is, the soldering pins 31 of the upper row are received in the slots 161 and extend to enter the space above the yield slots 521. The power terminals 3 in the lower row partially extend to enter the space below the yield slots 521, that is, the soldering pins 31 of the lower row are received in the slots 161 and extend to the space below the yield slots 521. The two power core wires 63 are located correspondingly in the two yield slots 521 and soldered to the soldering pins 31 of the upper row and the soldering pins 31 of the lower row. Since the extension portion 52 is provided with the yield slots 521 corresponding to the soldering pins 31 of the upper row and the soldering pins 31 of the lower row, the power terminal 3 of the upper row and the power terminal 3 of the lower row can share a core wire, so that the number of the power core wires 63 is reduced, and moreover, the shielding effect of the shielding sheet 5 on the interference signals of the signal terminals 4 will not be affected. Because the width of the yield slot 521 is greater than the width of the soldering pin 31, not only can the soldering pins 31 of the upper row and the soldering pins 31 of the lower row be soldered conveniently to the power core wires 63 at the same time, but also enough distances exist between the soldering pins 31 of the upper row and the shielding sheet 5 and between the soldering pins 31 of the lower row and the shielding sheet 5, so that the soldering pins 31 of the upper row and the soldering pins 31 of the lower row are prevented from touching the shielding sheet 5 to cause short-circuiting.

Figure 7:
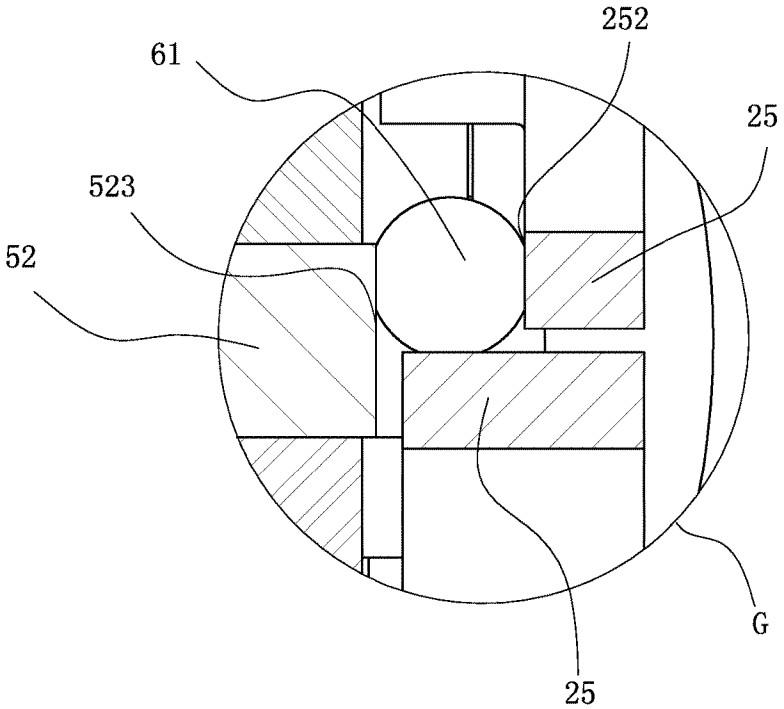
FIG. 7 is an enlarged view of part G in FIG. 6.
Figure 8:
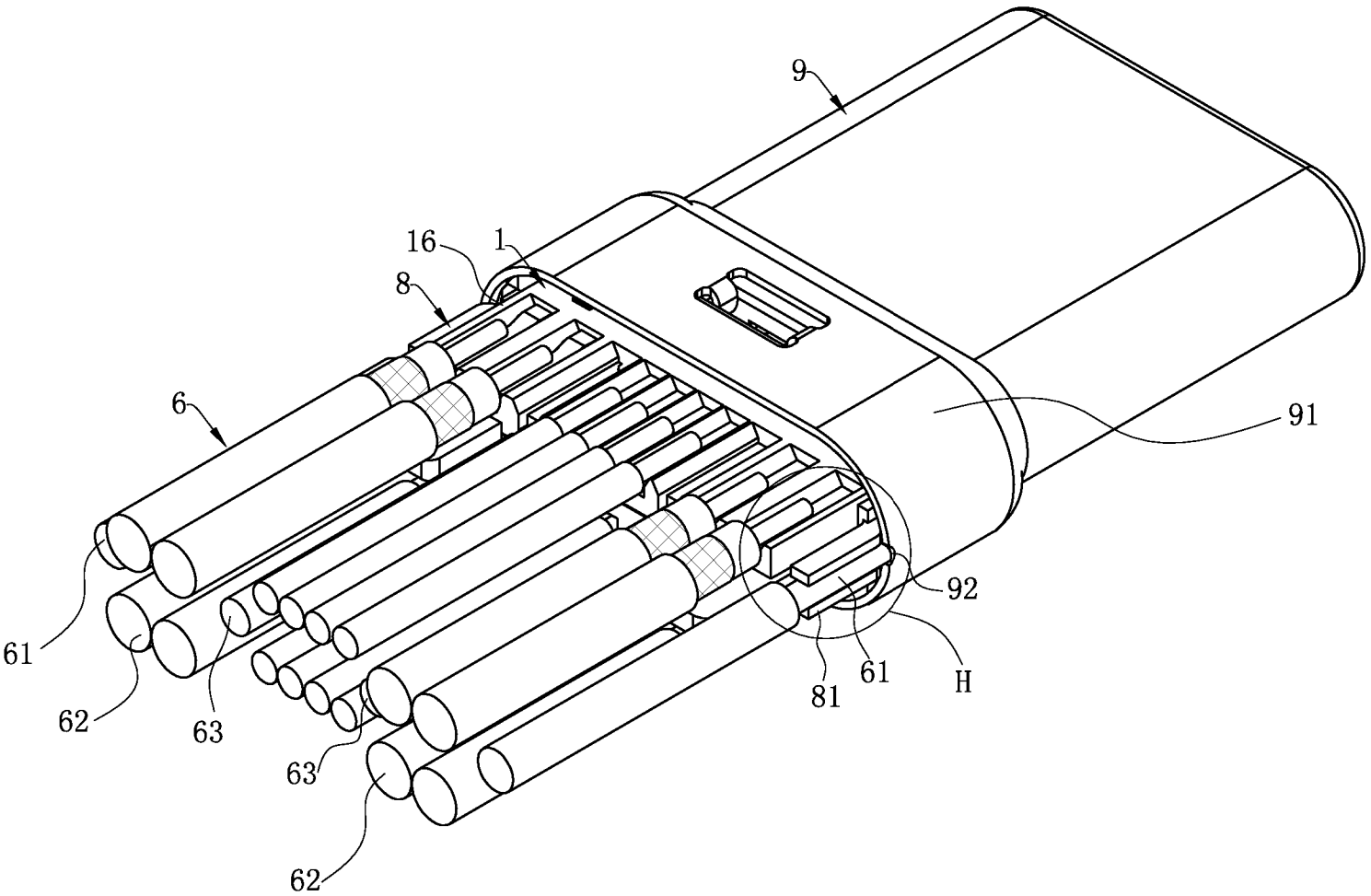
FIG. 8 is an assembly view of an electrical connector assembly according to a second embodiment of the present invention.
Figure 9:
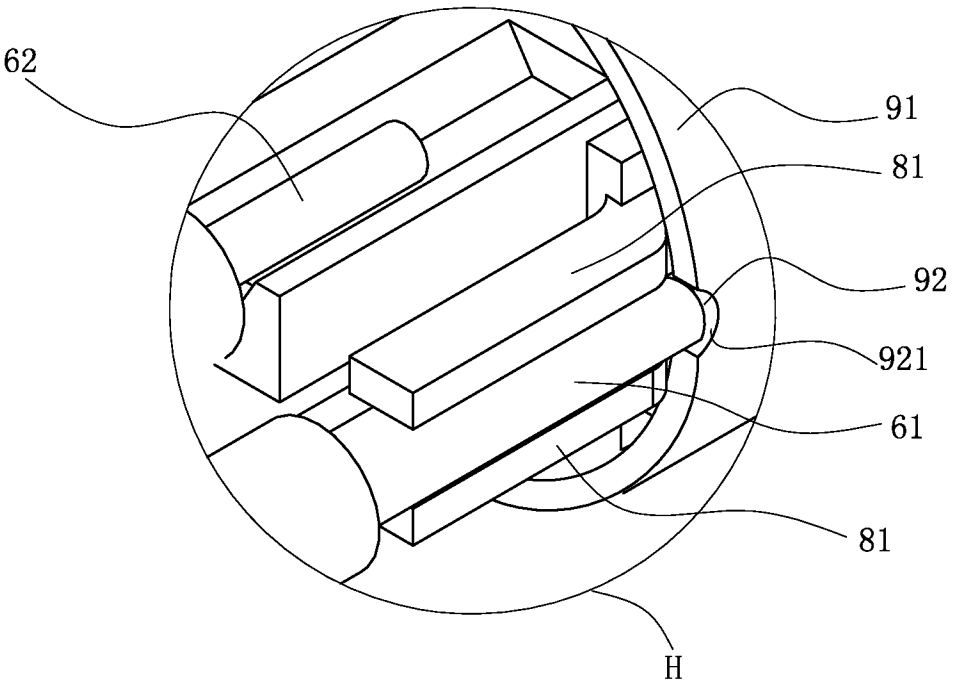
FIG. 9 is an enlarged view of part H in FIG. 8.
Figure 10:
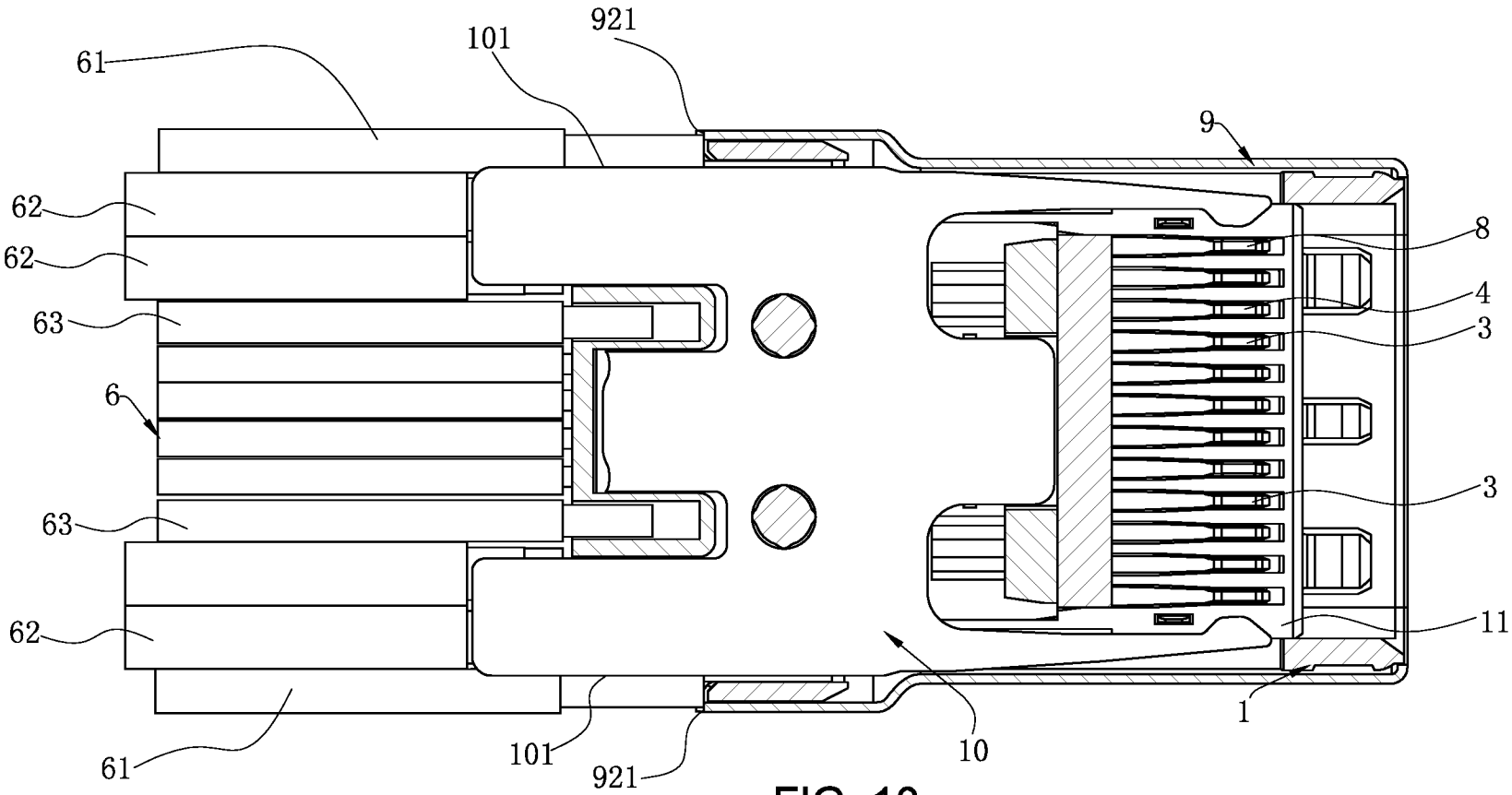
FIG. 10 is a sectional view of the electrical connector assembly according to the second embodiment of the present invention.
Figure 11:
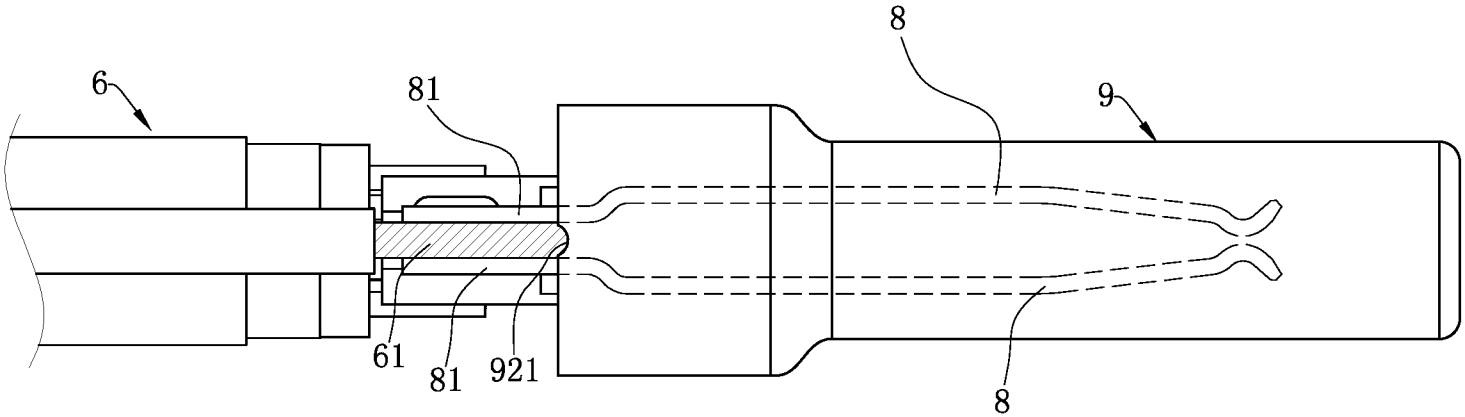
FIG. 11 is a side view of the electrical connector assembly according to the second embodiment of the present invention.

As shown in FIGS. 1, 6 and 7, in the present embodiment, the upper and lower surfaces of the shielding sheet 5 are smooth surfaces, the two opposite sides of the shielding sheet 5 are rough surfaces, the two opposite sides of the shielding sheet 5 are soldered respectively to the ground core wires 61, so that the shielding sheet 5 and the ground core wires 61 can be soldered firmly, and thereby it is ensured that the shielding sheet 5 has a good shielding effect. Specifically, the two opposite sides of the rear end of the extension portion 52 are provided respectively with a recessed notch 522, so that a stepped surface 523 is formed on the front side of each notch 522, the stepped surfaces 523 are located on the two opposite sides of the extension portion 52, and the arrangement of the notches 522 enables the ground core wires 61 to be received partially in the notches 522, so that the ground core wires 61 can be soldered conveniently to the stepped surfaces 523. Each stepped surface 523 is a rough surface, the ground core wires 61 are received partially in the notches 522 so as to be soldered to the stepped surfaces 523, so that the ground core wires 61 and the stepped surfaces 523 can be soldered firmly, preventing missing soldering. Consequently, the electrical connection between the shielding sheet 5 and the ground core wires 61 is stable, and it is ensured that the shielding sheet 5 has a good shielding effect. In the present embodiment, the ground core wires 61 are soldered to the stepped surfaces 523, that is, the ground core wires 61 are soldered to the rough surfaces of the shielding sheet 5. In the other embodiments, the ground core wires 61 may also not be soldered to the stepped surfaces 523, one side of the shielding sheet 5 is provided with a bending sheet, the smooth surface of the bending sheet is soldered to the ground core wires 61, and stable electrical connection can also be formed.

In the present embodiment, the metal ground member is the ground terminal 2, the upper and lower surfaces of the soldering portion 25 are provided with the plate surfaces 251, and the inner side of the soldering portion 25 is provided the cutting surface 252. In another embodiment, the metal ground member can be the shielding sheet 5, the shielding sheet 5 is located between the upper row of signal terminals 4 and the lower row of signal terminals 4, both the upper and lower surfaces of the shielding sheet 5 are provided with the plate surfaces 251, the two opposite sides of the shielding sheet 5 are provided with the cutting surfaces 252 which are soldered to the two ground core wires 61, the cutting surface 252 is rougher than the plate surface 251, consequently, the metal ground member can also be soldered firmly to the ground core wires 61, and it is ensured that the metal ground member has a good shielding effect. In the other embodiments, the metal ground member can be other metal parts, as long as it is ensured that the metal ground member is provided with a cutting surface soldered to the ground core wires 61.

As shown in FIGS. 1-4, the shielding shell 7 wraps the periphery of the insulating body 1, the insulating body 1 is fixed in the shielding shell 7, the placement platform 16 protrudes out of the rear end surface of the shielding shell 7, and the ground core wires 61 are located outside of the shielding shell 7 in order to be soldered to the cutting surfaces 252. Each of the top wall and bottom wall of the shielding shell 7 is provided with two inwardly protruding elastic fastening pieces 71, the top surface and bottom surface of the insulating body 1 are provided respectively with a fastening hole corresponding to the elastic fastening pieces 71, and the elastic fastening pieces 71 are fastened in the fastening holes to fix the shielding shell 7 on the insulating body 1.

FIGS. 8-11 show a second embodiment of the present invention. The difference from the first embodiment is that the metal ground member is a shielding shell 9, and the shielding shell 9 wraps the periphery of the insulating body 1 to shield outside noise signals. The outer wall surface of the shielding shell 9 is a smooth surface, that is, the outer wall surface of the metal part is the plate surface 91, the rear end of the shielding shell 9 is provided with the cutting surfaces 921, the cutting surfaces 921 are rough surfaces, the cutting surface 921 is rougher than the outer wall surface of the shielding shell 9, and the ground core wires 61 are soldered to the cutting surfaces 921. Consequently, the cutting surfaces 921 can be soldered conveniently to the ground core wires 61, and are soldered firmly, and missing soldering cannot be caused easily. In the present embodiment, the two opposite sides of the rear end of the shielding shell 9 are provided respectively with the cutting surfaces 921, and there are two ground core wires 61 which are soldered respectively to the two cutting surfaces 921. In the other embodiments, only one side of the rear end of the shielding shell 9 is provided with the cutting surface 921, as long as it is ensured that the number of the cutting surface 921 is consistent with the number of the ground core wire 61. A recessed portion 92 is recessed forward from at least one side of the rear end of the shielding shell 9. In the present embodiment, the recessed portions 92 are formed by being respectively recessed forward from the two opposite sides of the rear end of the shielding shell 9, the wall surfaces of the recessed portions 92 are the cutting surfaces 921, and the ground core wires 61 get into the recessed portions 92 so as to be soldered to the cutting surfaces 921. Not only can the arrangement of the recessed portions 92 enable the ground core wires 61 to be aligned with the cutting surfaces 921, so that the ground core wires 61 can be conveniently aligned with and soldered to the cutting surfaces 921, but also the recessed portions 92 can stop the displacement of the ground core wires 61 in the vertical direction and at the front, playing the role of limiting the ground core wires 61 to prevent the ground core wires 61 from being pulled by external force to cause the soldered portions to get loose.

Referring to FIGS. 8-11, the front end of the insulating body 1 is provided with a backwardly recessed insertion cavity 11, the signal terminals 4 are arranged respectively on the upper side and lower side of the insertion cavity 11 to form an upper row and a lower row, at least one ground terminal 8 is arranged on the outermost side of the signal terminals 4 of each row, each ground terminal 8 is provided with a soldering portion 81, the soldering portion 81 of the upper row and the soldering portion 81 of the lower row are aligned with each other in the vertical direction, the soldering portion 81 of the upper row and the soldering portion 81 of the lower row respectively clamp the upper side and lower side of the ground core wire 61 and are soldered to the ground core wire 61, the cutting surface 921 is located between the soldering portion 81 of the upper row and the soldering portion 81 of the lower row along the vertical direction and soldered to the front end of the ground core wire 61, so that the ground terminal 8 of the upper row, the ground terminal 8 of the lower row and the cutting surface 921 of the shielding shell 9 share the ground core wire 61. Consequently, the number of the ground core wire 61 is reduced, and thereby, not only is the manufacturing cost reduced, but also the manufacturing process is simplified. Moreover, because the soldering portion 81 of the upper row and the soldering portion 81 of the lower row clamp and fix the ground core wire 61, the ground terminals 8 and the ground core wires 61 can be soldered more firmly. One side, which is far from the signal terminals 4, of the soldering portion 81 of each ground terminal 8 urges against the rear end surface of the shielding shell 9, so that the ground terminals 8 are connected electrically with the shielding shell 9, and thereby the shielding effect of the shielding shell 9 is enhanced. In the present embodiment, two ground terminals 8 are arranged on the outermost side of the signal terminals 4 of each row and soldered correspondingly to the two ground core wires 61. A shielding sheet 10 is fixed in the insulating body 1 and located between the upper row of signal terminals 4 and the lower row of signal terminals 4, the shielding sheet 10 is in a shape of a flat plate, and the shielding sheet 10 is located on one side of the ground core wires 61 along the horizontal direction, and is soldered to the side surfaces of the ground core wires 61. Since there are two ground core wires 61, the shielding sheet 10 is provided with two opposite sides 101 which are soldered respectively to the side surfaces of the two ground core wires 61. In the present embodiment, the ground core wires 61 are soldered to the sides 101 of the shielding sheet 10, that is, the ground core wires 61 are soldered to the rough surfaces of the shielding sheet 10. In the other embodiments, the ground core wires 61 may not be soldered to the rough surfaces of the shielding sheet 10, as long as it is ensured that the ground core wires 61 are soldered to the shielding sheet 10. The metal ground member is the shielding shell 9, the rear end of the shielding shell 9 is provided with the cutting surfaces 921, the ground core wires 61 are soldered to the cutting surfaces 921, consequently, the cutting surfaces 921 can also be soldered conveniently to the ground core wires 61, and are soldered firmly, and missing soldering cannot be caused easily.

In summary, the electrical connector assembly according to certain embodiments of the present invention has the following beneficial advantages:

(1) Since the frictional force between the cutting surfaces 252 and the ground core wires 61 is great, the cutting surfaces 252 can be soldered conveniently to the ground core wires 61, and are soldered firmly, missing soldering cannot be caused easily, the soldered portions of the metal ground members and the ground core wires 61 cannot get loose even if the cable 6 is pulled by external force, poor electrical contact is prevented, and it is ensured that the metal ground members have a good shielding effect.

(2) The arrangement of the deflecting portions 22 increases the distance between the two soldering portions 25 of the same row, so that the space for receiving the signal core wires 62 is enlarged, consequently, the signal core wires 62 can be soldered conveniently to the signal terminals 4; moreover, since the soldering portions 25 are all located on the outer side of the placement platform 16 and soldered to the ground core wires 61, the space of the placement platform 16 is not occupied, consequently, the space of the placement platform 16 is saved, and the overall volume of the electrical connector assembly is reduced.

(3) The two opposite sides of the rear end of the extension portion 52 are provided respectively with a recessed notch 522, so that a stepped surface 523 is formed on the front side of each notch 522, the stepped surfaces 523 are located on the sides of the extension portion 52, and the arrangement of the notches 522 enables the ground core wires 61 to be received partially in the notches 522, so that the ground core wires 61 can be soldered conveniently to the stepped surfaces 523.

(4) Each stepped surface 523 is a rough surface, the ground core wires 61 are received partially in the notches 522 so as to be soldered to the stepped surfaces 523, so that the ground core wires 61 and the stepped surfaces 523 can be soldered firmly, preventing missing soldering, consequently, the electrical connection between the shielding sheet 5 and the ground core wires 61 is stable, and it is ensured that the shielding sheet 5 has a good shielding effect.

(5) The recessed portions 92 are formed by being respectively recessed forwardly from the two opposite sides of the rear end of the shielding shell 9, the inner wall surfaces of the recessed portions 92 are the cutting surfaces 921, and the ground core wires 61 get into the recessed portions 92 so as to be soldered to the cutting surfaces 921. Not only can the arrangement of the recessed portions 92 enable the ground core wires 61 to be aligned with the cutting surfaces 921, so that the ground core wires 61 can be conveniently aligned with and soldered to the cutting surfaces 921, but also the recessed portions 92 can stop the displacement of the ground core wires 61 in the vertical direction and at the front, playing the role of limiting the ground core wires 61 to prevent the ground core wires 61 from being pulled by external force to cause the soldered portions to get loose.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

an insulating body, wherein a front end of the insulating body is recessed backward with an insertion cavity;

a plurality of signal terminals received in the insulating body, wherein the plurality of signal terminals are arranged respectively on an upper side and a lower side of the insertion cavity to form an upper row and a lower row;

two metal ground members fixed on the insulating body, the two metal ground members being two ground terminals, and each of the metal ground members having a plate surface and a cutting surface connected with the plate surface, wherein each of the two ground terminals is arranged on an outermost side of the plurality of signal terminals of each of the upper row and the lower row, a front end of each of the ground terminals is provided with a contact portion, a rear end of each of the ground terminals is provided with a soldering portion protruded out of the insulating body, at least one of an upper surface and a lower surface of the soldering portion is provided with the plate surface, and an inner side of the soldering portion is provided with the cutting surface perpendicular to the plate surface; and a cable comprising:

a plurality of signal core wires respectively soldered to the plurality of signal terminals; and two ground core wires respectively soldered to the cutting surface of the ground terminal in the upper row and the cutting surface of the ground terminal in the lower row, wherein a shielding sheet is fixed in the insulating body and located between the upper row of signal terminals and the lower row of signal terminals, and the ground core wires are located between the ground terminals and the shielding sheet and soldered to the shielding sheet.

2. The electrical connector assembly of claim 1, wherein in each of the ground terminals, a deflecting portion is formed by deflecting and extending from the contact portion in a direction away from one side of the signal terminals, a connecting portion is formed by extending backward from the deflecting portion, a bending portion is formed by being bent and extending from the connecting portion, and a soldering portion is formed by horizontally extending backward from the bending portion.

3. The electrical connector assembly of claim 1, wherein among the two ground terminals on the same side of the insertion cavity along the vertical direction, a width of the soldering portion of the ground terminal in the upper row is less than a width of the soldering portion of the ground terminal in the lower row, so that the cutting surface of the metal ground member in the upper row can be soldered to a side surface of the ground core wire and the plate surface of the ground terminal in the lower row can be soldered to a lower surface of the ground core wire.

4. The electrical connector assembly of claim 1, wherein the ground terminals in the upper row and the ground terminals in the lower row are arranged in mutual point symmetry with a central point of the insertion cavity as a center of symmetry.

5. The electrical connector assembly of claim 1, wherein at least one power terminal is arranged among the plurality of signal terminals of each row, and the plurality of signal terminals, the ground terminals and the power terminal of the upper row and the plurality of signal terminals, the ground terminals and the power terminal of the lower row are arranged in mutual point symmetry with a central point of the insertion cavity as a center of symmetry.

6. The electrical connector assembly of claim 5, wherein the shielding sheet is provided with a base fixed in the insulating body, an extension portion extends backward from the base, at least one yield slot is recessed forwardly from a rear end edge of the extension portion, the power terminal in the upper row partially extends and enters to above the yield slot, the power terminal in the lower row partially extends and enters to below the yield slot, the cable is provided with at least one power core wire, and the power core wire is located in the yield slot and soldered to the power terminal of the upper row and the power terminal of the lower row.

7. The electrical connector assembly of claim 6, wherein the upper surface and lower surface of the rear end of the insulating body are provided respectively with at least one slot corresponding to the yield slot, and both the power terminal in the upper row and the power terminal in the lower row are provided with two soldering pins which are respectively located correspondingly in the slots so as to be soldered to the power core wire.

8. The electrical connector assembly of claim 7, wherein a width of the yield slot is greater than a width of the soldering pin.

9. The electrical connector assembly of claim 6, wherein the ground terminal, the power terminal and the plurality of signal terminals in the upper row and an upper insulating block are inject molded as a whole, the ground terminal, the power terminal and the plurality of signal terminals in the lower row and a lower insulating block are inject molded as a whole, a rear end of the insulating body is recessed forward with a receiving cavity, the upper insulating block and the lower insulating block jointly clamp and fix the shielding sheet and are mounted in the receiving cavity, and form a placement platform protruding out of a rear end of the receiving cavity, the plurality of signal core wires are arranged respectively in two rows on the upper surface and lower surface of the placement platform so as to be soldered correspondingly to the plurality of signal terminals of the upper row and the plurality of signal terminals of the lower row, and the two ground core wires are located respectively on the two opposite outer sides of the placement platform so as to be soldered to the cutting surface of the upper row and the cutting surface of the lower row.

10. An electrical connector assembly, comprising:

an insulating body;

a plurality of signal terminals received in the insulating body;

a metal ground member fixed on the insulating body, the metal ground member having a plate surface and a cutting surface connected with the plate surface; and a cable comprising:

a plurality of signal core wires respectively soldered to the plurality of signal terminals; and at least one ground core wire soldered to the cutting surface, wherein the metal ground member is a shielding sheet, the plurality of signal terminals are arranged into an upper row and a lower row in the insulating body, the shielding sheet is located between the signal terminals of the upper row and the signal terminals of the lower row, both an upper surface and a lower surface of the shielding sheet are provided with the plate surfaces, and at least one side of the shielding sheet is provided with the cutting surface.

11. The electrical connector assembly of claim 10, wherein the shielding sheet is provided with a base fixed in the insulating body, a pair of latch arms respectively extends forward from both sides of the base and are received in the insulating body, an extension portion extends backward from the base, both opposite sides of the extension portion are provided with the cutting surfaces, and there are two ground core wires, which are respectively soldered correspondingly to the cutting surfaces of both sides of the extension portion.

12. The electrical connector assembly of claim 11, wherein two opposite sides of a rear end of the extension portion are provided respectively with a concave notch, so that a stepped surface is formed on the front side of each notch, each stepped surface is the cutting surface, and the ground core wires are received partially in the notches so as to be soldered to the stepped surfaces.

13. An electrical connector assembly, comprising:

an insulating body, wherein a front end of the insulating body is recessed backward with an insertion cavity;

a plurality of signal terminals received in the insulating body, wherein the plurality of signal terminals are arranged respectively on an upper side and a lower side of the insertion cavity to form an upper row and a lower row;

a metal ground member fixed on the insulating body, the metal ground member having a plate surface and a cutting surface connected with the plate surface; and a cable comprising:

a plurality of signal core wires respectively soldered to the plurality of signal terminals; and at least one ground core wire soldered to the cutting surface, wherein the metal ground member is a shielding shell, the shielding shell wraps a periphery of the insulating body, an outer wall surface of the shielding shell is the plate surface, and a rear end of the shielding shell is provided with the cutting surface, and wherein at least one ground terminal is arranged on an outermost side of the plurality of signal terminals of each of the upper row and the lower row, each ground terminal is provided with a soldering portion, the soldering portion of the upper row and the soldering portion of the lower row respectively clamp upper side and lower side of the ground core wire and are soldered to the ground core wire, and the cutting surface is located between the soldering portion of the upper row and the soldering portion of the lower row along a vertical direction and soldered to the ground core wire.

14. The electrical connector assembly of claim 13, wherein a recessed portion is recessed forward from at least one side of the rear end of the shielding shell, a wall surface of the recessed portion is the cutting surface, and the ground core wire gets into the recessed portion so as to be soldered to the cutting surface.

15. The electrical connector assembly of claim 13, wherein an outer side of the soldering portion of each ground terminal urges against the shielding shell.

16. The electrical connector assembly of claim 13, wherein a shielding sheet is fixed in the insulating body and located between the upper row of signal terminals and the lower row of signal terminals, there are two ground core wires, the shielding sheet is provided with two opposite sides which are soldered respectively to side surfaces of the ground core wires, and two opposite sides of a rear end of the shielding shell are provided respectively with the cutting surfaces which are soldered to the ground core wires.

* * * * *